US009318878B2

(12) United States Patent
Kasuya et al.

(10) Patent No.: US 9,318,878 B2
(45) Date of Patent: Apr. 19, 2016

(54) SPARK PLUG WITH NOBLE METAL TIP

(75) Inventors: Yuji Kasuya, Tokyo (JP); Yoshikazu Kataoka, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 94 days.

(21) Appl. No.: 14/235,468

(22) PCT Filed: May 15, 2012

(86) PCT No.: PCT/JP2012/003160

§ 371 (c)(1),
(2), (4) Date: Jan. 28, 2014

(87) PCT Pub. No.: WO2013/018256

PCT Pub. Date: Feb. 7, 2013

(65) Prior Publication Data

US 2014/0152170 A1 Jun. 5, 2014

(30) Foreign Application Priority Data

Aug. 3, 2011 (JP) ..... 2011-169698

(51) Int. Cl.
*H01T 13/06* (2006.01)
*H01T 13/32* (2006.01)
*H01T 13/39* (2006.01)

(52) U.S. Cl.
CPC ..... *H01T 13/06* (2013.01); *H01T 13/32* (2013.01); *H01T 13/39* (2013.01)

(58) Field of Classification Search
CPC ..... H01T 13/06; H01T 13/32; H01T 13/39
See application file for complete search history.

(56) References Cited

U.S. PATENT DOCUMENTS

| | | | | |
|---|---|---|---|---|
| 6,533,628 | B1 * | 3/2003 | Matsutani | 445/7 |
| 2002/0017846 | A1 * | 2/2002 | Hori | 313/141 |
| 2002/0121849 | A1 * | 9/2002 | Kanao et al. | 313/141 |
| 2005/0023949 | A1 * | 2/2005 | Hori | 313/141 |
| 2011/0025185 | A1 | 2/2011 | Torii et al. | 313/141 |

FOREIGN PATENT DOCUMENTS

| | | | |
|---|---|---|---|
| JP | 2004-134209 | 4/2004 | H01T 13/20 |
| JP | 4210204 | 1/2009 | H01T 13/20 |
| WO | WO 2009/084565 | 7/2009 | H01T 13/32 |

OTHER PUBLICATIONS

Form PCT/ISA/210—Int'l Search Report (from corresponding Int'l Patent App. No. PCT/JP2012/003160-English version only); 1 page.

* cited by examiner

*Primary Examiner* — Jacob R Stern
(74) *Attorney, Agent, or Firm* — Kusner & Jaffe

(57) ABSTRACT

In a section of a spark plug cut by a plane which passes through the center of gravity of the intermediate member and is in parallel with the facing direction between a center electrode and an extending portion of a ground electrode, a spark plug that satisfies the relational expression $S1/(D1 \times H1) \geq 0.005$, where S1 is the total area of nuggets, H1 is the height of the end surface of a noble metal tip from the disposition surface of an electrode base metal, and D1 is the maximum width of the noble metal tip.

9 Claims, 12 Drawing Sheets

| Sample No. | Nugget presence or absence (nugget position/range) | Nugget area S1 ($mm^2$) | Width D1 (mm) | Height H1 (mm) | Nugget ratio St (S1)/(D1 × H1) | Residuary percentage P (N2/N1) × 100 | Result |
|---|---|---|---|---|---|---|---|
| 1 | Absent | 0.000 | 0.75 | 0.84 | 0.000 | 0% | Poor |
| 2 | Present (one side/outside tip range) | 0.002 | 0.75 | 0.84 | 0.003 | 23% | Poor |
| 3 | Present (one side/outside tip range) | 0.003 | 0.75 | 0.84 | 0.005 | 55% | Good |
| 4 | Present (one side/inside tip range) | 0.003 | 0.75 | 0.84 | 0.005 | 61% | Good |
| 5 | Present (both sides/outside tip range) | 0.003 | 0.75 | 0.84 | 0.005 | 68% | Good |
| 6 | Present (both sides/inside tip range) | 0.003 | 0.75 | 0.84 | 0.005 | 74% | Good |
| 7 | Present (both sides/inside tip range) | 0.019 | 0.75 | 0.84 | 0.030 | 85% | Good |
| 8 | Present (on centerline) | 0.003 | 0.75 | 0.84 | 0.005 | 80% | Good |
| 9 | Present (on centerline) | 0.019 | 0.75 | 0.84 | 0.030 | 100% | Good |
| 10 | Absent | 0.000 | 1.40 | 0.40 | 0.000 | 0% | Poor |
| 11 | Present (one side/outside tip range) | 0.002 | 1.40 | 0.40 | 0.004 | 33% | Poor |
| 12 | Present (one side/outside tip range) | 0.003 | 1.40 | 0.40 | 0.005 | 53% | Good |
| 13 | Present (one side/inside tip range) | 0.003 | 1.40 | 0.40 | 0.005 | 58% | Good |
| 14 | Present (both sides/outside tip range) | 0.003 | 1.40 | 0.40 | 0.005 | 72% | Good |
| 15 | Present (both sides/inside tip range) | 0.003 | 1.40 | 0.40 | 0.005 | 77% | Good |
| 16 | Present (both side/inside tip range) | 0.016 | 1.40 | 0.40 | 0.029 | 88% | Good |
| 17 | Present (on centerline) | 0.003 | 1.40 | 0.40 | 0.005 | 81% | Good |
| 18 | Present (on centerline) | 0.016 | 1.40 | 0.40 | 0.029 | 100% | Good |

FIG. 4

FIG. 5(A) NUGGET ABSENT
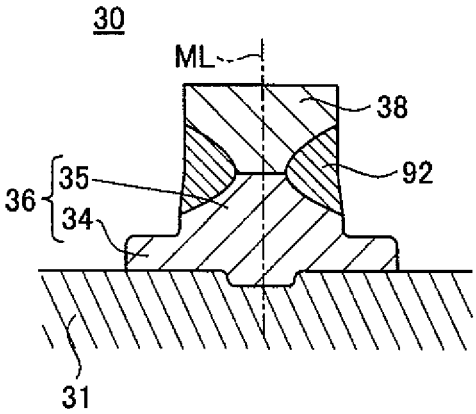
FIG. 5(B) NUGGET PRESENT (ONE SIDE/OUTSIDE TIP RANGE)
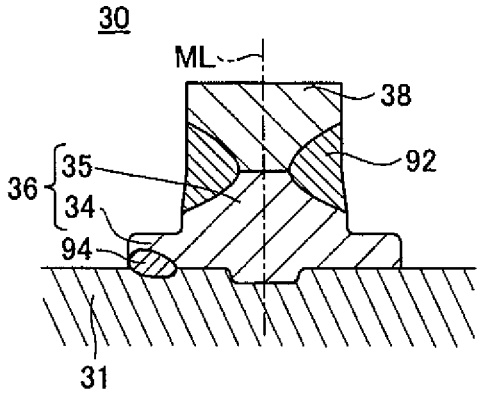
FIG. 5(C) NUGGET PRESENT (ONE SIDE/INSIDE TIP RANGE)
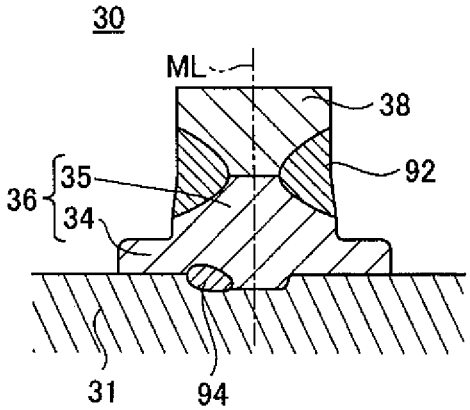
FIG. 5(D) NUGGET PRESENT (BOTH SIDES/OUTSIDE TIP RANGE)
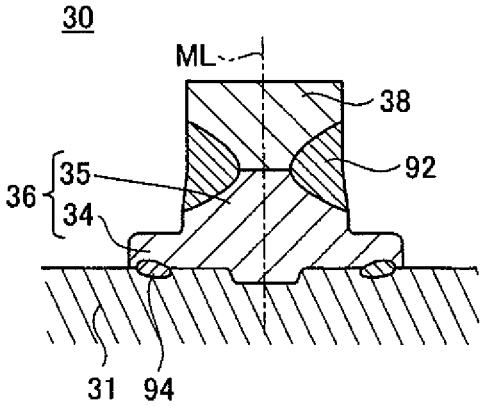
FIG. 5(E) NUGGET PRESENT (BOTH SIDES/INSIDE TIP RANGE)
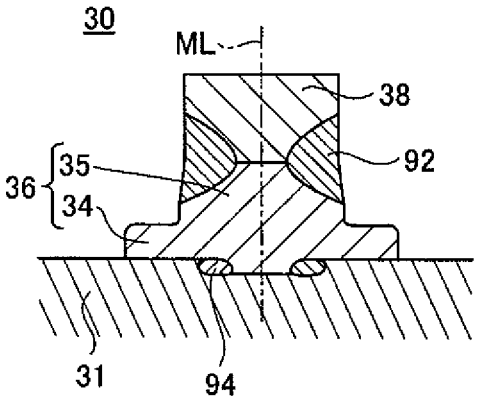
FIG. 5(F) NUGGET PRESENT (ON CENTERLINE)
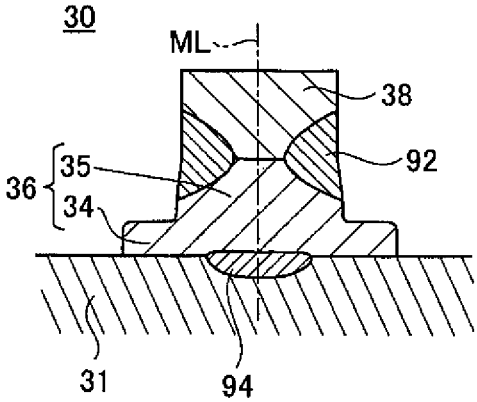

FIG. 6(A) NUGGET PRESENT
(ONE SIDE/OUTSIDE TIP RANGE)
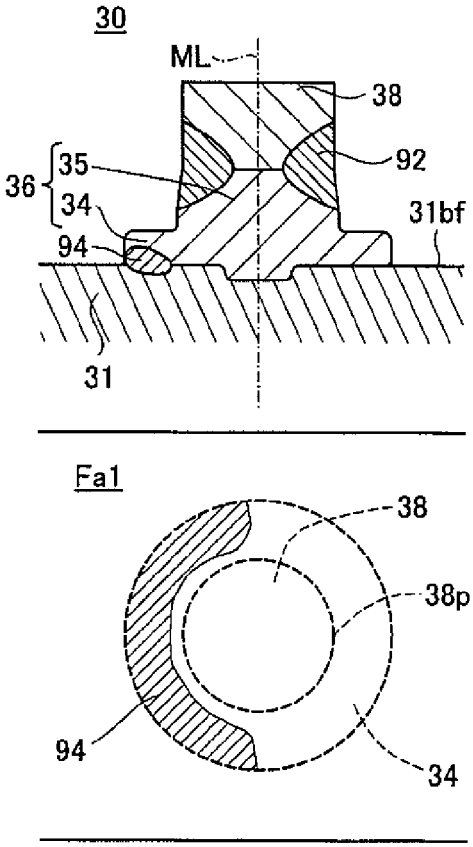
FIG. 6(B) NUGGET PRESENT
(ONE SIDE/INSIDE TIP RANGE)
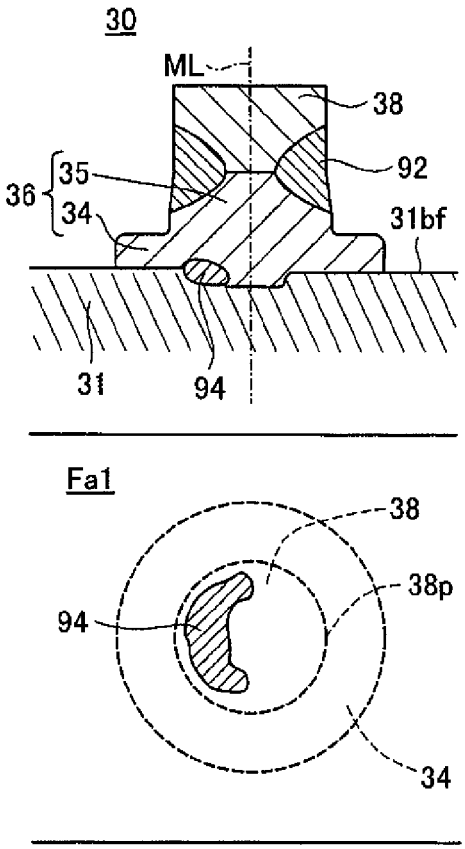
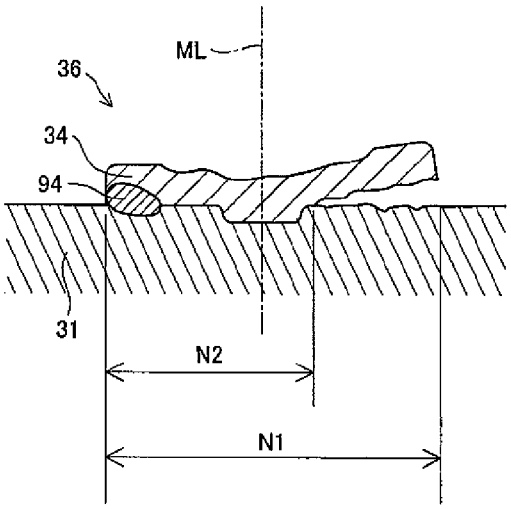
FIG. 7

| Sample No. | Nugget-outside-tip-range presence or absence (nugget position) | Area of outside nugget S3 ($mm^2$) | Width D2 (mm) | Height H2 (mm) | Outside nugget ratio Stv (S3)/(D2 × H2) | Separation percentage W (N3/N1) × 100 |
|---|---|---|---|---|---|---|
| 1A | Absent | 0.000 | 1.75 | 0.17 | 0.000 | 42% |
| 2A | Present (one side) | 0.005 | 1.75 | 0.17 | 0.017 | 35% |
| 3A | Present (one side) | 0.009 | 1.75 | 0.17 | 0.030 | 13% |
| 4A | Present (both sides) | 0.015 | 1.75 | 0.17 | 0.050 | 5% |
| 5A | Present (entire fusion surface) | 0.015 | 1.75 | 0.17 | 0.050 | 0% |
| 6A | Absent | 0.000 | 2.50 | 0.08 | 0.000 | 39% |
| 7A | Present (one side) | 0.004 | 2.50 | 0.08 | 0.020 | 32% |
| 8A | Present (one side) | 0.006 | 2.50 | 0.08 | 0.030 | 14% |
| 9A | Present (both sides) | 0.010 | 2.50 | 0.08 | 0.050 | 8% |
| 10A | Present (entire fusion surface) | 0.010 | 2.50 | 0.08 | 0.050 | 0% |

FIG. 8

FIG. 9(A)
NUGGET-OUTSIDE-TIP-RANGE ABSENT
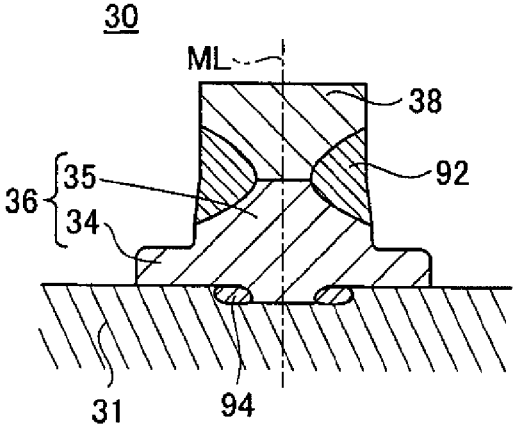
FIG. 9(B)
NUGGET-OUTSIDE-TIP-RANGE PRESENT (ONE SIDE)
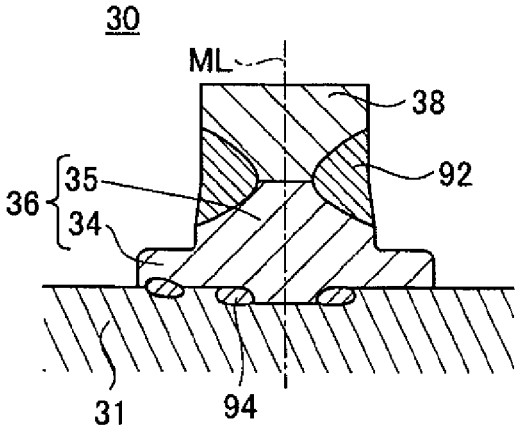
FIG. 9(C)
NUGGET-OUTSIDE-TIP-RANGE PRESENT (BOTH SIDES)
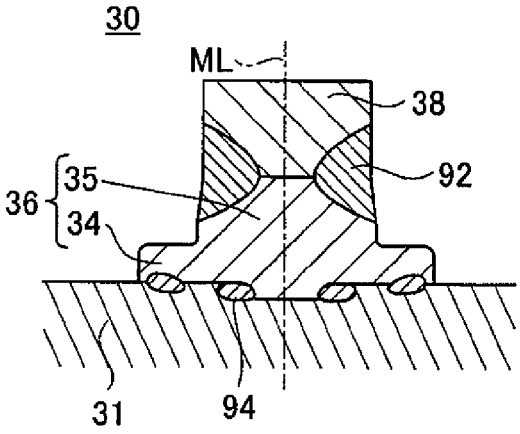
FIG. 9(D) NUGGET OVER ENTIRE FUSION SURFACE
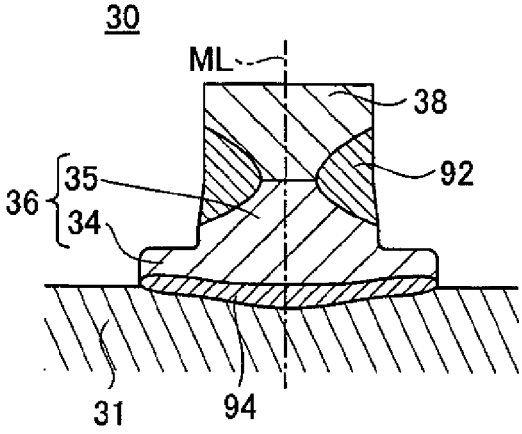

| Sample No. | Shortest distance L1 (mm) | Rupture load Nt (N) | Result |
|---|---|---|---|
| 1B | 0.05 | 102 | Fair |
| 2B | 0.10 | 173 | Good |
| 3B | 0.15 | 181 | Good |

A—A SECTION

SPARK PLUG WITH NOBLE METAL TIP

FIELD OF THE INVENTION

The present invention relates to a spark plug.

BACKGROUND OF THE INVENTION

Conventionally, a spark plug is used for providing ignition in an internal combustion engine such as a gasoline engine. In a spark plug, a spark discharge gap is formed between a center electrode and a ground electrode. Incidentally, there is known a spark plug in which a noble metal tip is attached on the electrode base metal of a ground electrode via an intermediate member (refer to, for example, International Publication WO02009/084565). The intermediate member is used for reducing the occurrence of a defect which could otherwise result from the noble metal tip being attached directly onto the electrode base metal. For example, through use of the intermediate member therebetween, while the amount of use of a noble metal is reduced, the area of joining to the electrode base metal can be increased. According to the technique mentioned in International Publication WO02009/084565, the intermediate member to which the noble metal tip is attached is joined to the electrode base metal by welding.

However, as a result of recent tendency toward higher engine outputs, the working environment of a spark plug is becoming more severe than before. Accordingly, the spark plug manufactured on the basis of the technique disclosed in International Publication WO02009/084565 has potentially suffered separation of the intermediate member from the electrode base metal as a result of the welding strength between the intermediate member and the electrode base metal failing to endure a working environment. Such a problem is not limited to the ground electrode, but is in common with a spark plug in which the noble metal tip is attached on the electrode base metal of the center electrode via the intermediate member.

Therefore, an advantage of the present invention is a technique for improving welding strength between the intermediate member and the electrode base metal.

SUMMARY OF THE INVENTION

Application Example 1

A spark plug comprising a center electrode extending in a direction of an axis, a ceramic insulator having an axial bore extending in the direction of the axis and holding the center electrode in the axial bore, a metallic shell provided externally of an outer circumference of the ceramic insulator, and a ground electrode having an extending portion extending in the direction of the axis, attached to the metallic shell at one end, and forming, at the other end, a gap in cooperation with the center electrode, the spark plug being characterized in that at least one of the center electrode and the ground electrode has an electrode base metal, a columnar noble metal tip disposed in such a manner as to face the other electrode, and an intermediate member disposed between the electrode base metal and the noble metal tip; the intermediate member has a first surface in contact with the noble metal tip and a second surface being in contact with the electrode base metal, located opposite the first surface, and having an area greater than that of a cross section of the noble metal tip cut by a plane parallel to the first surface; a nugget is formed through fusion and solidification resulting from welding at least a portion of a boundary between the intermediate member and the electrode base metal; and in a section of the spark plug cut by a plane which passes through the center of gravity of the intermediate member and is in parallel with a facing direction between the extending portion and the center electrode, a relational expression $S1/(D1\times H1)\geq 0.005$ is satisfied, where S1 is a total area of the nugget, H1 is a height of an end surface of the noble metal tip from a disposition surface of the electrode base metal where the intermediate member is disposed, and D1 is a maximum width of the noble metal tip. In the present specification, in specifying a parameter which takes the area of the nugget as a numerator and an area calculated on the basis of the shapes of the noble metal tip and the intermediate member as a denominator, the parameter value is specified to three decimal places as significant digits, and is rounded to three decimal places similar to the case of the present application example.

Application Example 2

A spark plug according to application example 1, wherein when the noble metal tip and the nugget are projected vertically onto a plane parallel with the disposition surface, the nugget includes a portion located inside an outline of the projected noble metal tip.

Application Example 3

A spark plug according to application examples 1 or 2, wherein in the section, the nugget is formed on opposite sides of a centerline which passes through the center of gravity and is perpendicular to the end surface.

Application Example 4

A spark plug according to application example 3, wherein in the section, the nugget is further formed at a location on the centerline.

Application Example 5

A spark plug according to any one of application examples 1 to 4, wherein a relational expression $S1/(D1\times H1)\geq 0.029$ is satisfied.

Application Example 6

A spark plug according to application example 2 or any one of application examples 3 to 5 depending from application example 2, wherein in the vertical projection, the nugget further includes a portion located outside the outline of the projected noble metal tip.

Application Example 7

A spark plug according to application example 6, wherein the intermediate member has an attachment portion greater in an area of a cross section cut by a plane parallel to the first surface than the noble metal tip; the attachment portion ranges from the disposition surface to a height of $0.2\times H1$; and in the section, a relational expression $S3/(H2\times D2)\geq 0.030$ is satisfied, where H2 is a height of the attachment portion from the disposition surface, D2 is a maximum width of the attachment portion, and S3 is a total area of those portions of the nugget which are formed between the attachment portion and the electrode base metal and are located outside the range of the noble metal tip with respect to the width direction of the attachment portion.

Application Example 8

A spark plug according to any one of application examples 1 to 7, wherein the nugget is formed internally in such a manner as to not be exposed at an outer surface of the intermediate member, and in the section, a relational expression L1≥0.10 mm is satisfied, where L1 is a shortest distance between the nugget and outlines of the intermediate member and the noble metal tip.

Application Example 9

A spark plug according to any one of application examples 1 to 7, wherein in the section, the nugget is formed along the overall boundary between the electrode base metal and the intermediate member.

The present invention can be embodied in various forms; for example, in addition to the spark plug mentioned above, a method of manufacturing a spark plug, an internal combustion engine equipped with spark plugs, and a vehicle equipped with spark plugs.

According to the spark plug described in application example 1, through satisfaction of the relational expression S1/(D1×H1)≥0.005, welding strength between the intermediate member and the electrode base metal can be improved. Notably, when the parameter value is rounded to three decimal places, satisfying the relational expression S1/(D1×H1) ≥0.005 suffices.

According to the spark plug described in application example 2, by means of the nugget including a portion located inside the outline of the projected noble metal tip, welding strength between the intermediate member and the electrode base metal can be improved as compared with the case where the nugget is located only outside the outline of the noble metal tip.

According to the spark plug described in application example 3, welding strength between the intermediate member and the electrode base metal can be improved as compared with the case where the nugget is formed only on one side of the centerline.

According to the spark plug described in application example 4, through further formation of the nugget at a location intersecting with the centerline, welding strength between the intermediate member and the electrode base metal can be further improved.

According to the spark plug described in application example 5, through satisfaction of the relational expression S1/(D1×H1)≥0.029, welding strength between the intermediate member and the electrode base metal can be far further improved.

According to the spark plug described in application example 6, by means of the nugget including not only a portion located inside the projected noble metal tip but also a portion located outside the projected noble metal tip, welding strength between the intermediate member and the electrode base metal can be improved as compared with the case where the nugget is located only inside the projected noble metal tip.

According to the spark plug described in application example 7, through satisfaction of the relational expression S3/(H2×D2)≥0.030, welding strength between the intermediate member and the electrode base metal can be further improved.

According to the spark plug described in application example 8, through formation of the nugget in the interior of the intermediate member and satisfaction of the relational expression L1≥0.10 mm, oxidation of the nugget can be restrained. By virtue of this, deterioration in welding strength between the intermediate member and the electrode base metal can be restrained.

According to the spark plug described in application example 9, welding strength between the intermediate member and the electrode base metal can be improved as compared with the case where the nugget is not formed along the overall boundary between the intermediate member and the electrode base metal.

BRIEF DESCRIPTION OF THE DRAWINGS

FIG. 4 is a table for explaining the samples used in a first experiment, and the results of the first experiment.

FIGS. 5(A)-5(F) are a first set of views for explaining the samples used in the first experiment.

FIGS. 6(A) and 6(B) are a second set of views for explaining the samples used in the first experiment.

FIG. 7 is a view for explaining the residuary percentage.

FIG. 8 is a table for explaining the samples used in a second experiment, and the results of the second experiment.

FIGS. 9(A)-9(D) are a set of views for explaining the samples used in the second experiment.

DETAILED DESCRIPTION OF PREFERRED EMBODIMENTS

Next, embodiments of the present invention will be described in the following order. A. Embodiment, and B. Modified embodiments.

A. Embodiment

A-1. Configuration of Spark Plug

Figure 1:
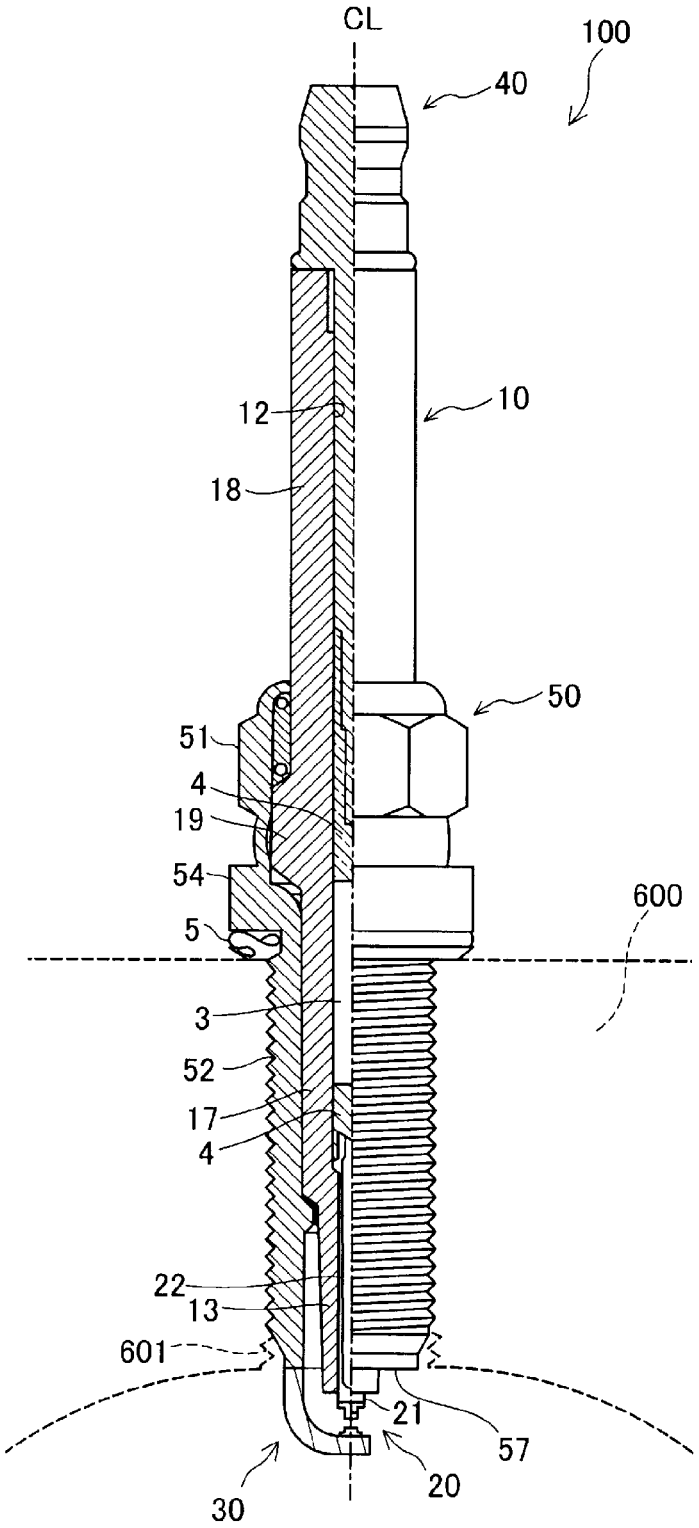
FIG. 1 is a sectional view of a spark plug 100 according to an embodiment of the present invention, showing essential portions thereof.

FIG. 1 is a sectional view of a spark plug 100 according to an embodiment of the present invention, showing essential portions thereof. For convenience of explanation, the upper side of the spark plug 100 in FIG. 1 may be referred to as one end side (rear side), and the lower side in FIG. 1 may be referred to as the other end side (forward side). The spark plug 100 includes a ceramic insulator 10, a center electrode 20, a ground electrode 30, a metal terminal 40, and a metallic shell 50. The rodlike center electrode 20 protrudes from the other end of the ceramic insulator 10 and is electrically connected to the metal terminal 40 provided at one end of the ceramic insulator 10, through the interior of the ceramic insulator 10. The center electrode 20 is held by the ceramic insulator 10. The ceramic insulator 10 is held by the metallic shell 50. The ground electrode 30 is electrically connected to the metallic shell 50 and forms a spark gap for generating sparks in cooperation with the forward end of the center electrode 20. The spark plug 100 is mounted, through the metallic shell 50, to a mounting threaded hole 601 provided in an engine head 600 of an internal combustion engine. For example, when a high voltage of 20,000 to 30,000 volts is applied to the metal terminal 40, a spark is generated across the spark gap formed between the center electrode 20 and the ground electrode 30.

The ceramic insulator 10 is an insulator formed from a ceramic material such as alumina by firing. The ceramic insulator 10 is a tubular member having an axial bore 12 formed at the center for accommodating the center electrode 20 and the metal terminal 40. The ceramic insulator 10 has a central trunk portion 19 formed at its center with respect to the direction of an axis CL of the spark plug 100 and having an outside diameter greater than that of the remaining portion. The ceramic insulator 10 has a rear trunk portion 18 formed on a side toward the metal terminal 40 (one end side) of the central trunk portion 19 for electrically insulating the metal terminal 40 and the metallic shell 50 from each other. The ceramic insulator 10 has a forward trunk portion 17 formed on a side toward the center electrode 20 of the central trunk portion 19 and having an outside diameter smaller than that of the rear trunk portion 18. The ceramic insulator 10 further has a leg portion 13 formed on the forward side of the forward trunk portion 17 and having an outside diameter which is smaller than that of the forward trunk portion 17 and which reduces toward the side toward the center electrode 20 (the other end side).

The metallic shell 50 is a cylindrical metal member and surrounds and holds a portion of the ceramic insulator 10 ranging from a portion of the rear trunk portion 18 to the leg portion 13. The metallic shell 50 can be formed of, for example, metal, and the present embodiment uses low-carbon steel or the like. The metallic shell 50 includes a tool engagement portion 51, a mounting threaded portion 52, and a seal portion 54. A tool (not shown) for mounting the spark plug 100 to the engine head 600 is fitted to the tool engagement portion 51 of the metallic shell 50. The mounting threaded portion 52 of the metallic shell 50 has a thread to be threadingly engaged with the mounting threaded hole 601 of the engine head 600. The seal portion 54 of the metallic shell 50 is formed at the root of the mounting threaded portion 52 and assumes the form of a collar. An annular gasket 5 formed by folding a sheet material is fitted between the seal portion 54 and the engine head 600. A forward end surface 57 of the metallic shell 50 is annular.

The center electrode 20 is a rodlike member configured such that a core metal 22 is embedded in a closed-bottomed tubular electrode base metal 21, the core metal 22 being superior to the electrode base metal 21 in thermal conductivity. In the present embodiment, the electrode base metal 21 is formed of a nickel alloy which contains nickel as a main component. In the present embodiment, the core metal 22 is formed of copper or an alloy which contains copper as a main component. The center electrode 20 is inserted into the axial bore 12 of the ceramic insulator 10 in such a manner that the forward end of the electrode base metal 21 protrudes from the axial bore 12 of the ceramic insulator 10, and is electrically connected to the metal terminal 40 via a ceramic resistor 3 and a seal member 4.

Figure 2A:
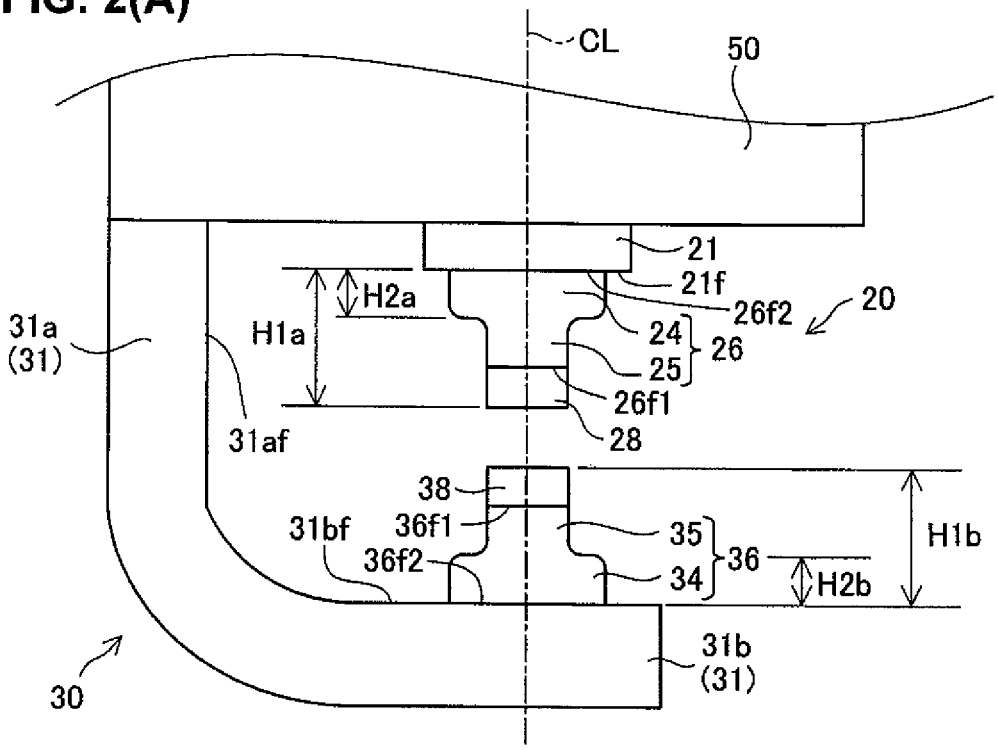
FIGS. 2(A) and 2(B) are a set of views for explaining the details of a center electrode 20 and a ground electrode 30.
Figure 2B:
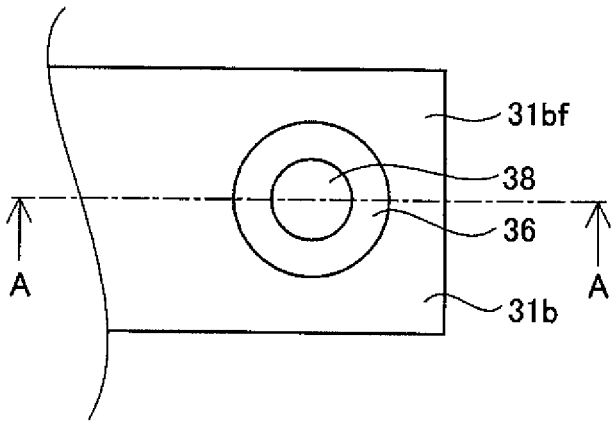

FIG. 2 is a set of views for explaining the details of the center electrode 20 and the ground electrode 30. FIG. 2(A) is a view showing a forward end portion of the center electrode 20, the ground electrode 30, and their vicinity. FIG. 2(B) is a view from the center electrode 20, showing a noble metal tip 38 and an intermediate member 36 which are used with the ground electrode 30.

As shown in FIG. 2(A), the center electrode 20 further includes an intermediate member 26 and a noble metal tip 28. The intermediate member 26 is disposed on a surface of the electrode base metal 21 (also referred to as "on the forward end surface" or "on the disposition surface") which faces the other end portion 31*b* of the ground electrode 30, which will be described later. The two members 21 and 26 are joined together by resistance welding. A fusion zone (also referred to as "nugget") is formed, by resistance welding, between the electrode base metal 21 and the intermediate member 26 through fusion and solidification of components of the two members 21 and 26. The noble metal tip 28 is disposed on a surface of the intermediate member 26 which faces the other end portion 31*b*, which will be described later. The two members 26 and 28 are joined together by laser welding. A fusion zone is formed, by laser welding, between the noble metal tip 28 and the intermediate member 26 through fusion and mixing of components of the two members 26 and 28. In the present embodiment, the noble metal tip 28 is disposed on the intermediate member 26 in such a manner that the center of gravity of the intermediate member 26 before welding and the center of gravity of the noble metal tip 28 before welding are located on the same line perpendicular to the surface of the electrode base metal 21 ("disposition surface 21*f*") where the intermediate member 26 is disposed. The disposition surface 21*f* is orthogonal to the direction of the axis CL.

The intermediate member 26 can be formed by use of a metal member. The present embodiment uses an alloy which contains nickel (Ni) as a main component, and aluminum (Al) and silicon (Si) in a total amount of 1.5 mass % or more. A material for the intermediate member 26 is not limited to a nickel alloy; for example, the intermediate member 26 may be formed of an alloy which contains platinum (Pt) as a main component, an alloy which contains palladium (Pd) as a main component, or the same material as that of the electrode base metal 21. Preferably, the intermediate member 26 has a linear expansion coefficient along the direction of the axis CL between those of the electrode base metal 21 and the noble metal tip 28. Employment of such a linear expansion coefficient can restrain stresses generated between the intermediate member 26 and the noble metal tip 28 and between the intermediate member 26 and the electrode base metal 21. As a result, there can be restrained separation between the intermediate member 26 and the noble metal tip 28 and separation between the intermediate member 26 and the electrode base metal 21.

The intermediate member 26 has a columnar shape extending along the direction of the axis CL. In the present embodiment, the intermediate member 26 includes a circular columnar attachment portion 24 joined directly to the electrode base metal 21, and a circular columnar column portion 25 extending toward the other end side (forward side) from the attachment portion 24. A first surface 26*f*1 of the intermediate member 26 is in contact with the noble metal tip 28. A second surface 26*f*2 of the intermediate member 26 opposite the first surface 26*f*1 is in contact with the electrode base metal 21. The first and second surfaces 26*f*1 and 26*f*2 are parallel to each other and are orthogonal to the direction of the axis CL. The second surface 26*f*2 is greater in area than the first surface 26*f*1. Furthermore, the second surface 26*f*2 is greater in area than a cross section of the noble metal tip 28 cut by a plane parallel to the first surface 26*f*1. The intermediate member 26 is joined to the electrode base metal 21 at the center of the circular disposition surface 21*f*. Meanwhile, H1a is the height of the end surface of the noble metal tip 28 from the disposition surface 21*f*, and H2a is the height of the attachment portion 24 from the disposition surface 21*f*. In this case, the relational expression H2a=H1a×0.2 is established. The disposition surface 21*f* is a flat surface.

The noble metal tip 28 is joined to the intermediate member 26 in order to improve resistance to spark-induced erosion. The noble metal tip 28 of the present embodiment is formed of platinum (Pt). The noble metal tip 28 has a circular columnar shape. Also, the noble metal tip 28 is substantially identical to the column portion 25 in the area of a cross section cut by a plane parallel with the first surface 26*f*1. The noble metal tip 28 is joined to the first surface 26*f*1 in such a manner that the end surface (distal end surface) of the noble metal tip 28 and the end surface (distal end surface) of a noble metal tip of the ground electrode 30, which will be described later, face each other. The noble metal tip 28 can be formed of not only platinum but also iridium (Ir), ruthenium (Ru), rhodium (Rh), or alloys of these metals.

The ground electrode 30 has an electrode base metal 31, the intermediate member 36, and the noble metal tip 38. The electrode base metal 31 can be formed by use of a metal member. In the present embodiment, INCONEL (registered trademark) 601, which is an alloy that contains nickel (Ni) as a main component, is used to form the electrode base metal 31. The electrode base metal 31 is formed by use of a rectangular bar whose cross section orthogonal to the longitudinal direction thereof has a substantially rectangular shape. The electrode base metal 31 extends from the metallic shell 50 toward the other end side along the direction of the axis CL and is bent at its intermediate portion so as to face the distal end surface of the noble metal tip 28. In the present embodiment, the electrode base metal 31 has a shape resembling the letter L. A proximal end portion (also referred to as "one end portion" or "rear end portion") 31*a* of the electrode base metal 31 is connected directly to the metallic shell 50 and extends in the direction of the axis CL. The other end portion (also referred to as "distal end portion") 31*b* of the electrode base metal 31 faces the distal end surface of the noble metal tip 28, thereby forming the spark gap. The proximal end portion 31*a* is joined to the forward end surface of the metallic shell 50 by resistance welding. The proximal end portion 31*a* corresponds to the "extending portion" appearing in the section SUMMARY OF THE INVENTION.

The intermediate member 36 and the noble metal tip 38 are identical in shape to the intermediate member 26 and the noble metal tip 28, respectively, of the center electrode 20 and are in vertically reversed relation with the members 26 and 28. A first surface 36*f*1 of the intermediate member 36 is in contact with the noble metal tip 38, and a second surface 36*f*2 opposite the first surface 36*f*1 is in contact with the electrode base metal 31. The intermediate member 36 is disposed on a surface 31*bf* (also referred to as "disposition surface 31*bf*") of the other end portion 31*b* which faces the noble metal tip 28, and the two members 31 and 36 are joined together by resistance welding. A fusion zone (also referred to as "nugget") is formed, by resistance welding, between the electrode base metal 31 and the intermediate member 36 through fusion and solidification of components of the two members 31 and 36. The noble metal tip 38 is disposed on a surface of the intermediate member 36 which faces the electrode base metal 21, and the two members 36 and 38 are joined together by laser welding. A fusion zone is formed, by laser welding, between the noble metal tip 38 and the intermediate member 36 through fusion and mixing of components of the two members 36 and 38. The disposition surface 31*bf* is a flat surface.

Similar to the intermediate member 26 of the center electrode 20, the intermediate member 36 can be formed by use of a metal member. The present embodiment uses an alloy which contains nickel (Ni) as a main component, and aluminum (Al) and silicon (Si) in a total amount of 1.5 mass % or more. Similar to the intermediate member 26 of the center electrode 20, any other member may be used to form the intermediate member 36.

The intermediate member 36 has a columnar shape extending along a direction perpendicular to the disposition surface 31*bf* (in the present embodiment, the direction of the axis CL). In the present embodiment, the intermediate member 36 includes a circular columnar attachment portion 34 joined directly to the electrode base metal 31, and a circular columnar column portion 35 extending toward the center electrode 20 from the attachment portion 34. As shown in FIG. 2(B), the intermediate member 36 is joined to the disposition surface 31*bf* with predetermined gaps formed between the intermediate member 36 and the outer edge of the disposition surface 31*bf*. As shown in FIGS. 2(A) and 2(B), the attachment portion 34 is greater in diameter than the noble metal tip 38. That is, in a plane parallel to the first surface 36*f*1, the attachment portion 34 is greater in area than the noble metal tip 38. Meanwhile, H1b is the height of the end surface of the noble metal tip 38 from the disposition surface 31*bf* of the electrode base metal 31 where the intermediate member 36 is disposed, and H2b is the height of the attachment portion 34 from the disposition surface 31*bf*. In this case, the relational expression H2b=H1b×0.2 is established. In the present embodiment, in order to distinguish between the heights (H1a, H2a) of the attachment portion 24 and the noble metal tip 28 of the center electrode 20 and the heights (H1b, H2b) of the attachment portion 34 and the noble metal tip 38 of the ground electrode 30, different symbols are used. However, height H1 collectively represents the heights of the end surfaces of the noble metal tips 28 and 38 from the disposition surfaces 21*f* and 31*bf*, respectively, and height H2 collectively represents the heights of the attachments portions 24 and 34 from the disposition surfaces 21*f* and 31*bf*, respectively.

The noble metal tip 38 of the ground electrode 30 is joined to the intermediate member 36 in order to improve resistance to spark-induced erosion. Similar to the noble metal tip 28, the noble metal tip 38 of the present embodiment is formed of platinum (Pt). The noble metal tip 38 has a circular columnar shape. Also, the noble metal tip 38 is substantially identical to the column portion 35 in the area of a cross section cut by a plane parallel with the first surface 36*fl*. The noble metal tip 38 is joined to the end surface of the column portion 35 and faces the noble metal tip 28 of the center electrode 20. The noble metal tip 38 can be formed of not only platinum but also iridium (Ir), ruthenium (Ru), rhodium (Rh), or alloys of these metals. Spark discharges are performed between the thus-formed noble metal tip 28 of the center electrode 20 and the noble metal tip 38 of the ground electrode 30.

Figure 3:
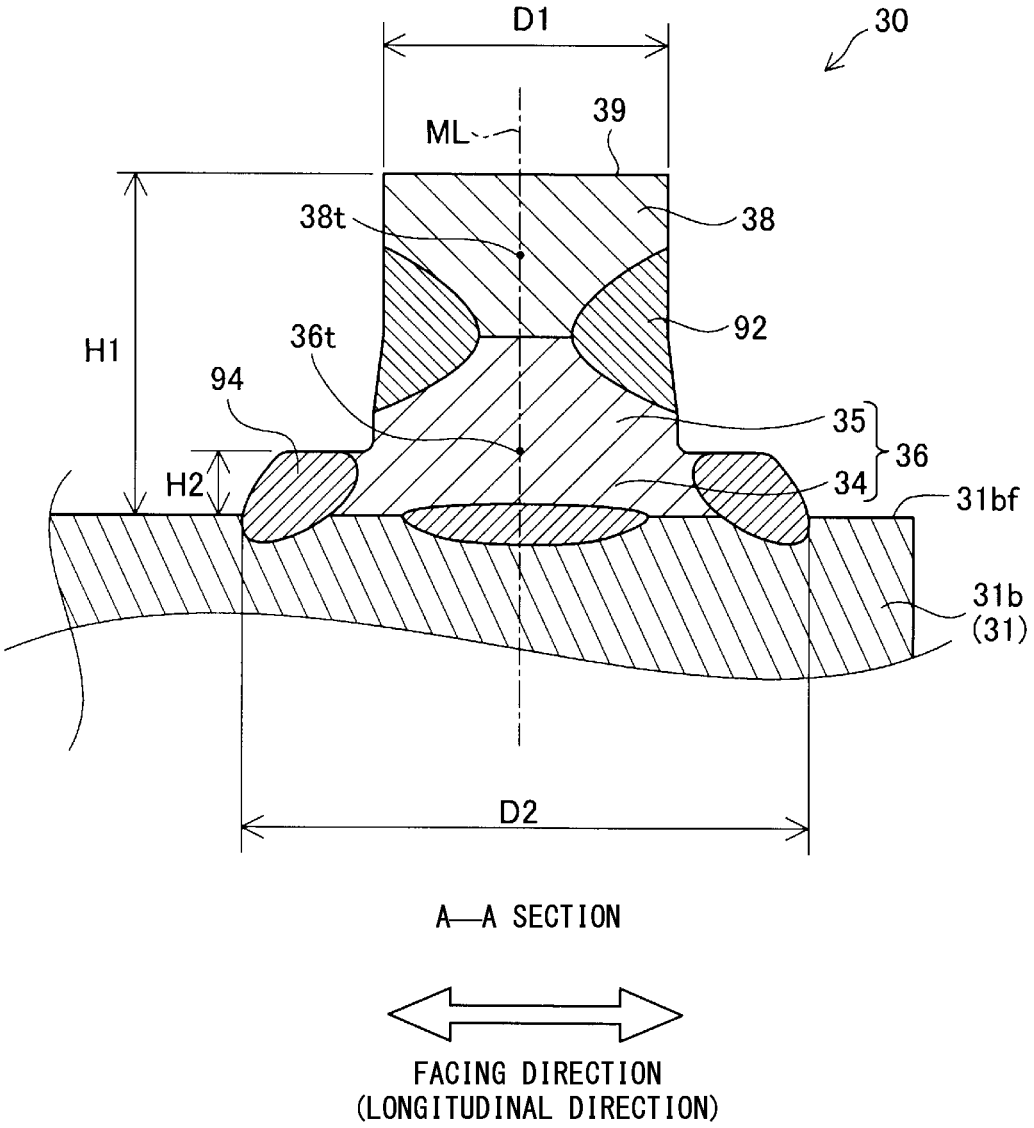
FIG. 3 is a sectional view taken along line A-A of FIG. 2(B).

FIG. 3 is a sectional view taken along line A-A of FIG. 2(B). The A-A section is a section of the spark plug 100 cut by a plane which passes through the center of gravity 36*t* of the intermediate member 36 and is in parallel with the facing direction (in FIGS. 2(A) and 2(B), left-right direction) between the one end portion 31*a* (FIG. 2(A)) and the center electrode 20 (the plane is also referred to as "parallel plane"). The facing direction is, in other words, a direction perpendicular to a surface 31*af* (FIG. 2(A)) which is of the one end portion 31*a* extending in the direction of the axis CL and which faces the center electrode 20. Also, in the present embodiment, the facing direction is in parallel with the longitudinal direction of the other end portion 31*b*. Also, the parallel plane in the present embodiment is in parallel with the direction of the axis CL and halves the electrode base metal 31 along the longitudinal direction. In the present embodiment, the parallel plane also passes through the center of gravity 38*t* of the noble metal tip 38.

The noble metal tip 38 has a width (diameter) D1. The attachment portion 34 has a maximum width (maximum diameter) D2. As shown in FIG. 3, a fusion zone 92 is formed, by laser welding, between the noble metal tip 38 and the intermediate member 36. Also, a nugget 94 is formed, by resistance welding, between the electrode base metal 31 and the intermediate member 36. Meanwhile, a centerline ML is a line which passes through the center of gravity 36*t* of the intermediate member 36 and is perpendicular to an end surface (upper end surface) 39 of the noble metal tip 38. In the present embodiment, the centerline ML and the axis CL coincides with each other. The widths D1 and D2 are of the noble metal tip 38 and of the attachment portion 34, respectively, before welding.

A-2. Experiment Results

Next, with reference to FIGS. 4 to 7, the results of a first experiment of the present invention will be described. FIG. 4 is a table for explaining the samples used in the experiment, and the results of the experiment. FIGS. 5(A)-5(F) are a first set of views for explaining the samples used in the experiment. FIGS. 6(A) and 6(B) are a second set of views for explaining the samples used in the experiment. FIG. 7 is a view for explaining a residuary percentage P. FIGS. 5(A) to 5(F), the upper views in FIGS. 6(A) and 6(B), and FIG. 7 are sectional views corresponding to the A-A section of FIG. 2(B). The lower views in FIGS. 6(A) and 6(B) show the noble metal tip 38 and the nugget 94 vertically projected onto a plane Fa1 parallel to the disposition surface 31*bf* and show the outlines of the noble metal tip 38 and the attachment portion 34 in the dashed lines.

As shown in FIG. 4, samples No. 1 to No. 18 were prepared, and the samples were subjected to an ultrasonic horn test. Samples No. 1 to No. 18 differ in presence or absence of the nugget 94, the position and size of the nugget 94, the width D1, and the height H1. The fusion zones 92 of samples No. 1 to No. 18 were formed through laser welding under the same conditions. In samples No. 1 to No. 9, the intermediate members 36 and the noble metal tips 38 have the same external shapes, respectively, and, in samples No. 10 to No. 18, the intermediate members 36 and the noble metal tips 38 have the same external shapes, respectively. Before description of the details of the ultrasonic horn test and the evaluation method, the details of samples No. 1 to No. 18 will be described.

As shown in FIG. 4, the samples have the following five types of nugget positions and ranges. Type 1 corresponds to, for example, the sample section view shown in FIG. 5(B). Type 2 corresponds to, for example, the sample section view shown in FIG. 5(C). Type 3 corresponds to, for example, the sample section view shown in FIG. 5(D). Type 4 corresponds to, for example, the sample section view shown in FIG. 5(E). Type 5 corresponds to, for example, the sample section view shown in FIG. 5(F). "Absence" in the "nugget presence or absence" column in samples No. 1 and No. 10 means the state shown in FIG. 5(A) and indicates a sample in which the intermediate member 36 is disposed on the electrode base metal 31 without performance of resistance welding.

Type 1: one side, outside tip range

Type 2: one side, inside tip range

Type 3: both sides, outside tip range

Type 4: both sides, inside tip range

Type 5: on centerline

The nugget position "one side" indicates that, as shown in FIGS. 5(B) and 5(C), in the A-A section of the sample, the nugget 94 is formed on either side of the centerline ML. The nugget position "both sides" indicates that, as shown FIGS. 5(D) and 5(E), in the A-A section of the sample, the nugget 94 is formed on both sides of the centerline ML. The nugget position/range "on centerline" indicates that, as shown in FIG. 5(F), in the A-A section of the sample, the nugget 94 is formed at a location intersecting with the centerline ML. Also, the nugget 94 located "on centerline" is formed "inside tip range." The concept "on centerline" encompasses the nugget position "both sides."

The nugget range "outside tip range" indicates that, as shown in FIGS. 5(B) and 5(D), in the A-A section of the sample, the nugget 94 is formed outside the range where the noble metal tip 38 is located with respect to the width direction (in FIG. 5, left-right direction) of the noble metal tip 38. In other words, the nugget range "outside tip range" indicates that, as shown in the lower view of FIG. 6(A), when the noble metal tip 38 and the nugget 94 are projected vertically onto the parallel plane Fa1, the projected nugget 94 is formed outside an outline 38*p* of the projected noble metal tip 38. The nugget range "inside tip range" indicates that, as shown in FIGS. 5(C) and 5(E), in the A-A section of the sample, the nugget 94 is formed inside the range where the noble metal tip 38 is located with respect to the width direction (in FIG. 5, left-right direction) of the noble metal tip 38. In other words, the nugget range "inside tip range" indicates that, as shown in the lower view of FIG. 6(B), when the noble metal tip 38 and the nugget 94 are projected vertically onto the parallel plane Fa1, the projected nugget 94 is formed inside the outline 38*p* of the projected noble metal tip 38.

The nugget 94 is formed as follows: a member configured such that the intermediate member 36 is disposed on the electrode base metal 31 is held between two electrodes, and electric current is applied between the electrodes for resistance welding. In the present embodiment, a member configured such that the noble metal tip 38 and the intermediate member 36 are joined together by laser welding (also referred to as "tip-joined intermediate member") is disposed on the electrode base metal 31, followed by resistance welding to form the nugget 94. One of the two electrodes is brought into contact with the intermediate member 36, and the other electrode is brought into contact with the electrode base metal 31. More specifically, in the present embodiment, while the two electrodes are disposed in the following manner, resistance welding is performed. One electrode is disposed in such a manner as to circumferentially surround the column portion 35 of the intermediate member 36 and the noble metal tip 38 and is brought into contact with the attachment portion 34. The other electrode is brought into contact with a surface of the electrode base metal 31 opposite the disposition surface where the intermediate member 36 is disposed. Meanwhile, samples No. 2 to No. 9 and No. 11 to No. 18 were formed by adjusting the position of application of electric current, the value of electric current, and load which the two electrodes apply to the electrode base metal 31 and the intermediate member 36. The position of the nugget 94 is adjusted by means of the position of application of electric current between the two electrodes. The size of the nugget 94 is adjusted by means of the value of electric current, and the load. The size of the nugget 94 increases as the load reduces and as the value of electric current increases. The nugget area S1 in FIG. 4 was calculated on the basis of the position and range of the nugget 94 obtained in the individual A-A sections of the samples which had undergone resistance welding under different conditions. The nugget ratio St in FIG. 4 was calculated by the following expression (1). The nugget ratio St in FIG. 4 is a value obtained by rounding the calculated value to three decimal places.

$$\text{Nugget ratio } St = S1/(D1 \times H1) \quad (1)$$

The ultrasonic horn test was conducted by applying ultrasonic waves of 27.3 kHz to the samples until the intermediate members 36 ruptured. The ultrasonic horn test was conducted by use of the samples which were prepared under such resistance welding conditions as to attain the nugget areas S1 and nugget positions of samples No. 1 to No. 18.

The strength of the nugget 94 was evaluated from the residuary percentage P (%) of the intermediate member 36 after the test. As shown in FIG. 7, the A-A sections of samples Nos. 1 to 18 were observed after the ultrasonic horn test, and the residuary percentage P(%) was calculated by the following expression (2). "Good" indicates that the residuary percentage P(%) has a good value of 50% or more, and "Poor" indicates that the residuary percentage P(%) has a poor value less than 50%.

$$\text{Residuary percentage } P = (N2/N1) \times 100 \quad (2)$$

where N1 is, in the A-A section, the length of a surface of the intermediate member 36 in contact with the electrode base metal 31 before the ultrasonic horn test, and N2 is, in the A-A section, the length of a surface of the intermediate member 36 in contact with the electrode base metal 31 after the ultrasonic horn test.

As shown in FIG. 4, the samples having a nugget ratio St of 0.005 or more exhibited a residuary percentage P of 50% or more, indicating an improved good welding strength between the electrode base metal 31 and the intermediate member 36. Furthermore, the samples having a nugget ratio St of 0.029 or more exhibited a residuary percentage P of 80% or more, indicated a further improved welding strength between the electrode base metal 31 and the intermediate member 36.

In comparison of the samples which differed only in nugget 94 range (e.g., sample No. 3 and sample No. 4, sample No. 5 and sample No. 6, sample No. 12 and sample No. 13, and sample No. 14 and sample No. 15), the samples having the nugget 94 range "inside tip range" were higher in residuary rate P, indicating that welding strength was further improved. That is, in comparison under such a condition that, as shown in FIG. 6, the noble metal tip 38 and the nugget 94 are vertically projected onto the parallel plane Fa1, the samples in which the projected nugget 94 is located inside the outline 38*p* of the projected noble metal tip 38 are higher in residuary percentage P than the samples in which the projected nugget 94 is located outside the outline 38*p* of the projected noble metal tip 38.

In comparison of the samples which differed only in nugget 94 position (e.g., sample No. 3 and sample No. 5, sample No. 4 and sample No. 6, sample No. 12 and sample No. 14, and sample No. 13 and sample No. 15), the samples having the nugget 94 on both sides were higher in residuary rate P, indicating that welding strength was further improved.

In comparison of the samples which had the nugget 94 on both sides and differed only in whether or not the nugget 94 intersected with the centerline ML (e.g., sample No. 6 and sample No. 8, sample No. 7 and sample No. 9, sample No. 15 and sample No. 17, and sample No. 16 and sample No. 18), the samples having the nugget 94 intersecting with the centerline ML were higher in residuary rate P, indicating that welding strength was further improved.

Figure 10A:
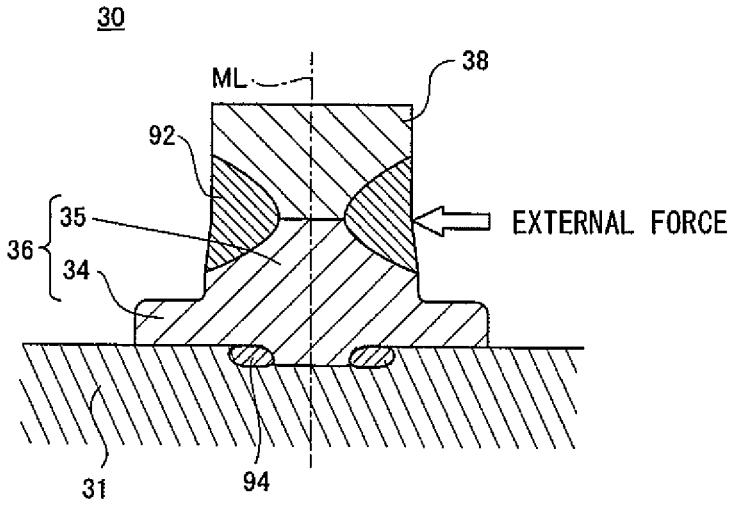
FIGS. 10(A) and 10(B) are a set of views for explaining the second experiment.
Figure 10B:
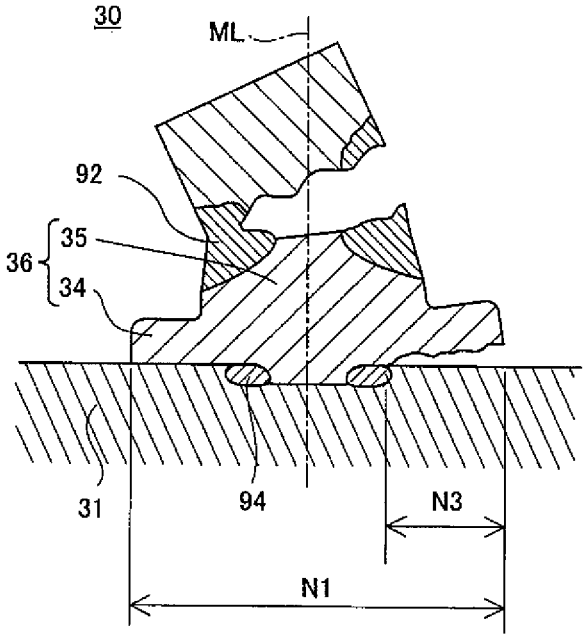

Next, with reference to FIGS. 8 to 10, the results of a second experiment will be described. FIG. 8 is a table for explaining the samples used in the second experiment, and the results of the second experiment. FIGS. 9(A)-9(D) are a set of views for explaining the samples used in the second experiment. FIGS. 10(A) and 10(B) are a set of views for explaining the second experiment. FIGS. 9 and 10 are sectional views corresponding to the A-A section of FIG. 2(B).

As shown in FIG. 8, samples No. 1A to No. 10A were prepared, and the samples were subjected to a bending rupture test. Samples No. 1A to No. 5A are similar to samples No. 1 to No. 9 used in the first experiment in external shapes of the noble metal tip 38 and the intermediate member 36, and samples No. 6A to No. 10A are similar to samples No. 10 to No. 18 used in the first experiment in external shapes of the noble metal tip 38 and the intermediate member 36. As shown in FIGS. 9(A) to 9(D), samples No. 1A to No. 10A have the nugget 94 located inside the tip range and on opposite sides of the centerline ML. Also, the samples No. 1A to No. 10A differ in presence or absence of the nugget 94, the position and size of the nugget 94 outside the tip range, width D2, and height H2. The fusion zones 92 of samples No. 1A to No. 10A were formed through laser welding under the same conditions. The nuggets 94 of samples No. 1A to No. 4A were formed inside the respective tip ranges under the same conditions, and the nuggets 94 of samples No. 6A to No. 9A were formed inside the respective tip ranges under the same conditions. The samples No. 1A to No. 10A have a nugget ratio St of 0.005 or more. Before description of details of the bending rupture test and description of the evaluation method, samples No. 1A to No. 10A will be described in detail.

As shown in FIG. 8, the samples have following four types of nugget positions. Type 1A corresponds to, for example, the sample section view shown in FIG. 9(A). Type 2A corresponds to, for example, the sample section view shown in FIG. 9(B). Type 3A corresponds to, for example, the sample section view shown in FIG. 9(C). Type 4A corresponds to, for example, the sample section view shown in FIG. 9(D). "Nugget over entire fusion surface" of type 4A indicates that, in the A-A section, the nugget 94 is formed along the overall range in the width direction (in FIG. 9, left-right direction) of the attachment portion 34. In other words, "nugget over entire fusion surface" of type 4A indicates that the nugget 94 is formed over the entire contact surface between the electrode base metal 31 and the intermediate member 36.

Type 1A: nugget outside tip range, absent

Type 2A: nugget outside tip range, one side

Type 3A: nugget outside tip range, both sides

Type 4A: nugget over entire fusion surface

In calculation of the outside nugget area S3 in FIG. 8, the samples which had undergone resistance welding under different conditions were cut along the A-A section, and the position of the nugget 94 existing outside the tip range was obtained in the individual A-A sections. The outside nugget ratio Stv was calculated by the following expression (3). The outside nugget ratio Stv in FIG. 8 is a value obtained by rounding the calculated value to three decimal places.

$$\text{Outside nugget ratio } Stv = S3/(D2 \times H2) \quad (3)$$

In the bending rupture test, as shown in FIG. 10(A), an external force was applied to a boundary portion between the noble metal tip 38 and the intermediate member 36 from one side toward the other side until the boundary portion between the noble metal tip 38 and the intermediate member 36 ruptured. The samples which have undergone the bending rupture test go into, for example, a state shown in FIG. 10(B). The bending rupture test was conducted by use of the samples which were prepared under such resistance welding conditions as to attain the outside nugget areas S3 and nugget positions of samples No. 1A to No. 10A.

The strength of the nugget 94 was evaluated from the separation percentage W of the intermediate member 36 after the test. As shown in FIG. 10(B), the A-A sections of samples No. 1A to No. 10A were observed after the bending rupture test, and the separation percentage W(%) was calculated by the following expression (4).

$$\text{Separation percentage } W(\%)=(N3/N1)\times 100 \quad (4)$$

where N1 is, in the A-A section, the length of a surface of the intermediate member 36 in contact with the electrode base metal 31 before the bending rupture test, similar to the evaluation method for the ultrasonic horn test of the first experiment, and N3 is, in the A-A section, the length of a surface of the intermediate member 36 separated from the electrode base metal 31 after the bending rupture test.

As shown in FIG. 8, in comparison of samples No. 1A to No. 5A whose intermediate members 36 and noble metal tips 38 had the same shapes, respectively, and in comparison of samples No. 6A to No. 10A whose intermediate members 36 and noble metal tips 38 had the same shapes, respectively, the samples having the nugget 94 formed outside the tip range were lower in the separation percentage W than the samples having no nugget 94 formed outside the tip range. That is, the samples having the nugget 94 formed outside the tip range in addition to the nugget 94 formed inside the tip range exhibited improved welding strength between the intermediate member 36 and the electrode base metal 31 as compared with the samples having the nugget 94 formed only inside the tip range.

Also, the samples having an outside nugget ratio Sty of 0.030 or more exhibited a separation percentage W of 15% or less, indicating that the separation percentage W was able to be reduced more than in the case of the samples having an outside nugget ration Sty less than 0.030. That is, the samples having an outside nugget ratio Sty of 0.030 or more were able to exhibit a further improved welding strength between the intermediate member 36 and the electrode base metal 31. Also, in comparison of the samples having the same outside nugget ratio Sty (e.g., sample No. 4A and sample No. 5A), the samples having the nugget 94 formed over the entire fusion surface were able to reduce the separation percentage W more, whereby the welding strength between the intermediate member 36 and the electrode base metal 31 was able to be further improved.

Figures 11A, 11B:
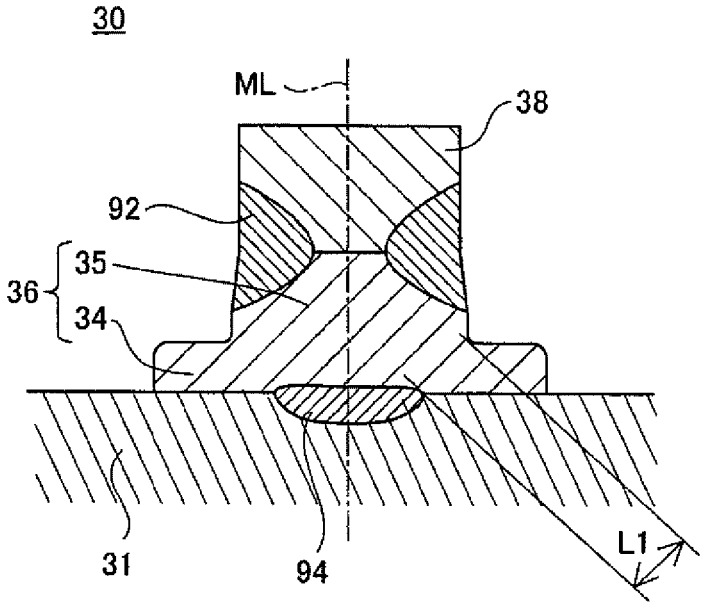
FIGS. 11(A) and 11(B) are a table and a set of views for explaining the results of a third experiment.

FIGS. 11(A) and 11(B) are a set of views for explaining the results of a third experiment. FIG. 11(A) is a table for explaining the samples used in the experiment and the results of the experiment. FIG. 11(B) is a view for explaining the samples used in the experiment. FIG. 11(B) is a sectional view corresponding to the A-A section of FIG. 2(B).

As shown in FIG. 11(A), samples No. 1B to No. 3B were prepared and were subjected to a burner-heating and cooling test and then to the bending rupture test. In samples No. 1B to 3B, the nugget 94 is formed internally in such a manner as to not be exposed at the outer surface of the intermediate member 36. Samples No. 1B to 3B were formed such that the size of the nugget 94 differed. That is, samples No. 1B to No. 3B were formed such that, in the A-A section, a shortest distance L1 (FIG. 11(B)) between the nugget 94 and the outlines of the intermediate member 36 and the noble metal tip 38 differed. The sizes of the nuggets 94 of samples No. 1B to 3B were adjusted by adjusting the value of current, and load in resistance welding. The intermediate members 36, the noble metal tips 38, and the electrode base metals 31 of samples No. 1B to No. 3B had the same external shapes, respectively. Samples No. 1B to No. 3B have a nugget ratio St of 0.005 or more.

In the burner-heating and cooling test, the samples were subjected to 1,000 cycles of heating and cooling, each consisting of heating the samples for two minutes by a burner so as to increase the sample temperature to 1,050° C. and subsequent cooling for one minute at the room temperature. The bending rupture test was conducted as follows: as shown in FIG. 10(A), an external force was applied to a boundary portion between the noble metal tip 38 and the intermediate member 36 from one side toward the other side until the intermediate member 36 (more specifically, the boundary portion between the noble metal tip 38 and the intermediate member 36) ruptured. An external force applied at the time of rupture of the intermediate member 36 was referred to as "rupture load Nt (N)."

Evaluation in the bending rupture test was as follows: a sample exhibiting a rupture load Nt less than 150 N was evaluated as "Fair," and a sample exhibiting a rupture load Nt of 150 N or more was evaluated as "Good." As shown in FIG. 11(A), the samples having a shortest distance L1 of 0.10 mm or more were evaluated as "Good." That is, in the samples having a shortest distance L1 of 0.10 mm or more, oxidation of the nugget 94 was able to be restrained, so that deterioration in welding strength provided by the nugget 94 was able to be restrained. Therefore, the samples having a shortest distance L1 of 0.10 mm or more can elongate the service life of the spark plug 100.

B. Modified Embodiments

Various embodiments of the present invention have been described above. However, the present invention is not limited to the embodiments and may be embodied in various other forms without departing from the spirit of the invention. For example, the following modifications are possible.

B-1. First to Fourth Modified Embodiments

Figure 12A:
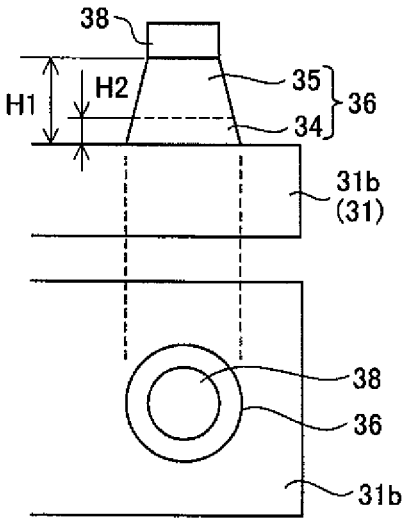
FIGS. 12(A)-12(D) are a set of views for explaining first to fourth modified embodiments.
Figure 12B:
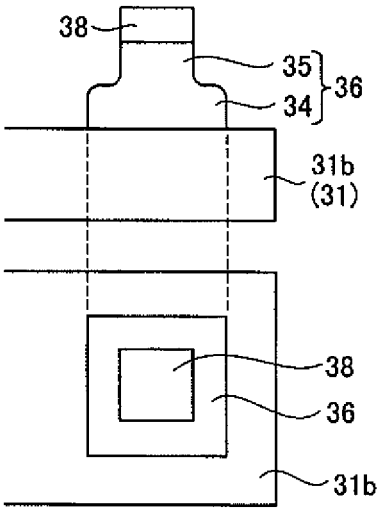
Figure 12:
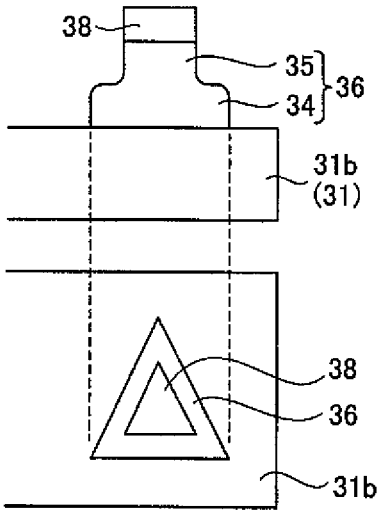
Figure 12D:
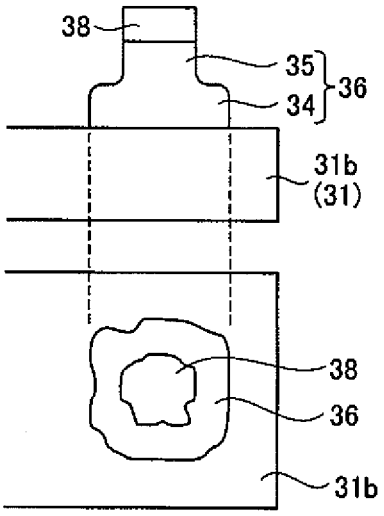

FIGS. 12(A)-12(D) are a set of views for explaining first to fourth modified embodiments. FIG. 12(A) is a view for explaining the first modified embodiment. FIG. 12(B) is a view for explaining the second modified embodiment. FIG. 12(C) is a view for explaining the third modified embodiment. FIG. 12(D) is a view for explaining the fourth modified embodiment. FIGS. 12(A) to 12(D) show the intermediate member 36 and the noble metal tip 38 attached to the electrode base metal 31, and their vicinity. In FIGS. 12(A) to 12(D), the lower views are plan views of the upper views, respectively.

In the embodiment described above, the intermediate member 36 disposed on the electrode base metal 31 includes the circular columnar attachment portion 34 and the circular columnar column portion 35 smaller in diameter than the attachment portion 34; however, the shape of the intermediate member 36 is not limited thereto, but the intermediate member 36 may have a shape (e.g., a columnar shape) standing on the electrode base metal 31. For example, as shown in FIG. 12(A), the intermediate member 36 may have the shape of a truncated cone. For easy understanding, the boundary between the column portion 35 and the attachment portion 34 of the intermediate member 36 is represented by the broken line. Also, for example, as shown in FIG. 12(B), the intermediate member 36 may have a shape of combination of square columns. Also, for example, as shown in FIG. 12(C), the intermediate member 36 may have a shape of combination of triangular columns. Also, for example, as shown in FIG. 12(D), the intermediate member 36 may have a shape of combination of polygonal columns, each having a complicatedly-shaped bottom surface and a complicatedly-shaped top surface.

In the embodiment described above, the noble metal tip 38 disposed on the intermediate member 36 has a circular columnar shape; however, the shape is not particularly limited. For example, the noble metal tip 38 may have the columnar shapes as shown in FIGS. 12(A) to 12(D). Also, the intermediate member 26 and the noble metal tip 28 of the center electrode 20 are not limited in shape to those of the embodiment, but may have various shapes similar to those of the modified embodiments mentioned above.

B-2. Fifth Modified Embodiment

Figure 13:
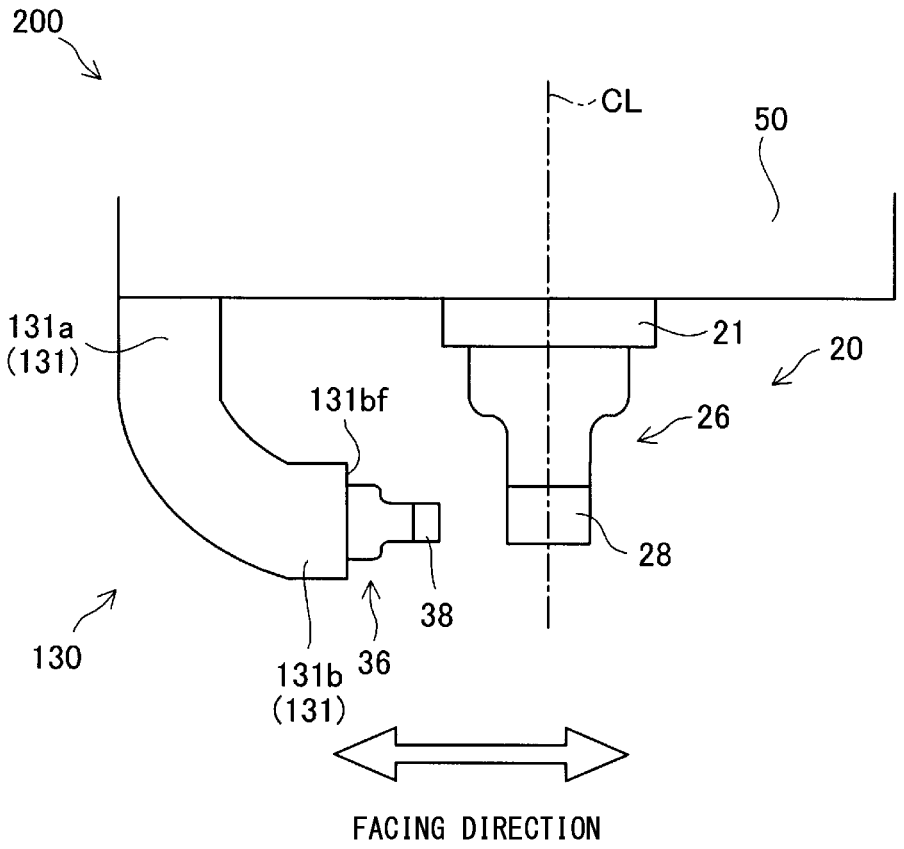
FIG. 13 is a view for explaining a spark plug 200 according a fifth modified embodiment.

FIG. 13 is a view for explaining a spark plug 200 according to a fifth embodiment. FIG. 13 shows the center electrode 20 and a ground electrode 130 and their vicinity of the spark plug 200. The fifth modified embodiment differs from the above embodiment in the shapes of an electrode base metal 131 of the ground electrode 130 and the disposition positions of the intermediate member 36 and the noble metal tip 38. Other configurational features are similar to those of the spark plug 100; therefore, description thereof is omitted.

In the embodiment described above, the end surface of the noble metal tip 28 of the center electrode 20 and the end surface of the noble metal tip 38 of the ground electrode 30 are in mutually facing relation (FIG. 2(A)); however, no particular limitation is imposed on their relation so long as a spark discharge gap is formed between a forward end portion of the center electrode 20 and a distal end portion of the ground electrode 30. For example, as shown in FIG. 13, the end surface (distal end surface) of the noble metal tip 38 of the ground electrode 130 may face the side surface of the noble metal tip 28 of the center electrode 20. In this case, the electrode base metal 131 of the ground electrode 130 is bent at its intermediate position such that the end surface (distal end surface) thereof faces the side surfaces of the intermediate member 26 and the noble metal tip 28 of the center electrode 20. Also, similar to the case of the embodiment described above, a proximal end portion (also referred to as "one end portion") 131*a* extending in the direction of the axis CL is connected to the metallic shell 50. In FIG. 13 also, the facing direction between the one end portion 131*a* and the center electrode 20 coincides with the left-right direction. Meanwhile, the one end portion 131*a* corresponds to the "extending portion" appearing in the section SUMMARY OF THE INVENTION.

B-3. Sixth Modified Embodiment

In the embodiment described above, the center electrode 20 and the ground electrode 30 include the intermediate members 26 and 36 and the noble metal tips 28 and 38, respectively; however, the intermediate member 26, 36 and the noble metal tip 28, 38 may be eliminated. Specifically, either one of the electrodes 20 and 30 may be configured such that the noble metal tip 28, 38 is disposed directly on the electrode base metal 21, 31. Also, either one of the electrodes 20 and 30 may be configured such that the intermediate member and the noble metal tip are eliminated. Even in these cases, it will suffice that the electrode 20, 30 having the intermediate member 26, 36 satisfies the relational expression nugget ratio St≥0.005. Through employment of this, at least the electrode 20, 30 having the intermediate member 26, 36 can exhibit an improved welding strength between the intermediate member 26, 36 and the electrode base metal 21, 31. Also, in the case where the center electrode 20 and the ground electrode 30 have the intermediate members 26 and 36, respectively, it will suffice that either one of the electrodes 20 and 30 satisfies the relational expression nugget ratio St≥0.005. Even in this case, the electrode which satisfies the relational expression nugget ratio St≥0.005 can exhibit an improved welding strength between the intermediate member and the electrode base metal.

DESCRIPTION OF REFERENCE NUMERALS

3: ceramic resistor
4: seal member
5: gasket
10: ceramic insulator
12: axial bore
13: leg portion
17: forward trunk portion
18: rear trunk portion
19: central trunk portion
20: center electrode
21: electrode base metal
22: core metal
24: attachment portion
25: column portion
26: intermediate member
26*f*1: first surface
26*f*2: second surface
28: noble metal tip
30: ground electrode
31: electrode base metal
31*a*: proximal end portion (one end portion, extending portion)
31*b*: other end portion
31*bf*: disposition surface
34: attachment portion
35: column portion
36: intermediate member
36*t*: center of gravity
36*f*1: first surface
36*f*2: second surface
38: noble metal tip
38*p*: outline
38*t*: center of gravity
39: end surface
40: metal terminal
50: metallic shell
51: tool engagement portion
52: mounting threaded portion
54: seal portion
57: forward end surface
92: fusion zone
94: nugget
100: spark plug
130: ground electrode
131: electrode base metal
131*a*: proximal end portion (one end portion, extending portion)
131*b*: distal end portion
131*bf*: disposition surface
200: spark plug
600: engine head
601: mounting threaded hole
CL: axis
ML: centerline

The invention claimed is:

1. A spark plug comprising:

a center electrode extending in a direction of an axis;

a ceramic insulator having an axial bore extending in the direction of the axis and holding the center electrode in the axial bore;

a metallic shell provided externally of an outer circumference of the ceramic insulator; and a ground electrode having an extending portion extending in the direction of the axis, attached to the metallic shell at one end, and forming, at the other end, a gap in cooperation with the center electrode, at least one of the center electrode and the ground electrode has an electrode base metal;

a columnar noble metal tip disposed in such a manner as to face the other electrode; and an intermediate member disposed between the electrode base metal and the noble metal tip, said intermediate member having a first surface and a second surface the first surface of said intermediate member being in contact with the noble metal tip and the second surface of the intermediate member being in contact with the electrode base metal, said second surface of said intermediate member having an area greater than that of a cross section of the noble metal tip defined by a plane cut parallel to the first surface;

said intermediate member attached to said electrode base member by a nugget that is formed through fusion and solidification resulting from welding at least a portion of the boundary between the intermediate member and the electrode base metal; and in a section of the spark plug cut by a plane which passes through the center of gravity of the intermediate member and is in parallel with a facing direction between the extending portion and the center electrode, a relational expression $S1/(D1\times H1)\geq 0.005$ is satisfied, where S1 is a total area of the nugget, H1 is a height of an end surface of the noble metal tip from a disposition surface of the electrode base metal where the intermediate member is disposed, and D1 is a maximum width of the noble metal tip.

2. A spark plug according to claim 1, wherein when the noble metal tip and the nugget are projected vertically onto a plane parallel with the disposition surface, the nugget includes a portion located inside an outline of the projected noble metal tip.

3. A spark plug according to claim 1 or 2, wherein in the section, the nugget is formed on opposite sides of a centerline which passes through the center of gravity and is perpendicular to the end surface.

4. A spark plug according to claim 3, wherein in the section, the nugget is further formed at a location on the centerline.

5. A spark plug according to claim 1 or 2, wherein a relational expression $S1/(D1\times H1)\geq 0.029$ is satisfied.

6. A spark plug according to claim 2, wherein in the vertical projection, the nugget further includes a portion located outside the outline of the projected noble metal tip.

7. A spark plug according to claim 6, wherein the intermediate member has an attachment portion greater in an area of a cross section cut by a plane parallel to the first surface than the noble metal tip;

the attachment portion ranges from the disposition surface to a height of $0.2\times H1$; and in the section, a relational expression $S3/(H2\times D2)\geq 0.030$ is satisfied, where H2 is a height of the attachment portion from the disposition surface, D2 is a maximum width of the attachment portion, and S3 is a total area of those portions of the nugget which are formed between the attachment portion and the electrode base metal and are located outside the range of the noble metal tip with respect to the width direction of the attachment portion.

8. A spark plug according to claim 1 or 2, wherein the nugget is formed internally in such a manner as to not be exposed at an outer surface of the intermediate member, and in the section, a relational expression $L1\geq 0.10$ mm is satisfied, where L1 is a shortest distance between the nugget and outlines of the intermediate member and the noble metal tip.

9. A spark plug according to claim 1 or 2, wherein in the section, the nugget is formed along the overall boundary between the electrode base metal and the intermediate member.

* * * * *